US005842808A

United States Patent [19]

Potter et al.

[11] Patent Number: 5,842,808

[45] Date of Patent: Dec. 1, 1998

[54] GOLF TRAINING CLUBS

[75] Inventors: George Arthur James Potter, 32 Wensleydale Drive, Heahterside, Camberly; Michael Godfrey Harman, both of Surrey, Great Britain

[73] Assignee: George Arthur James Potter, Surrey, United Kingdom

[21] Appl. No.: 545,751

[22] PCT Filed: May 9, 1994

[86] PCT No.: PCT/GB94/00994

§ 371 Date: Nov. 7, 1995

§ 102(e) Date: Nov. 7, 1995

[87] PCT Pub. No.: WO94/26363

PCT Pub. Date: Nov. 24, 1994

[30] Foreign Application Priority Data

May 7, 1993 [GB] United Kingdom ..... 9309434

[51] Int. Cl.[6] ..... F16D 7/00

[52] U.S. Cl. ..... 403/27; 403/92; 403/102; 403/157; 473/219; 473/231

[58] Field of Search ..... 403/27, 102, 92, 403/100, 95, 96, 157, 41; 473/232, 219, 223, 226, 231

[56] References Cited

U.S. PATENT DOCUMENTS

| | | | |
|---|---|---|---|
| 1,990,281 | 2/1935 | Grelle | 473/232 |
| 2,497,237 | 3/1950 | Reineking . | |
| 4,146,340 | 3/1979 | Smith, Jr. | 403/27 |
| 4,854,585 | 8/1989 | Koch et al. . | |
| 5,195,748 | 3/1993 | Koch et al. . | |
| 5,255,994 | 10/1993 | Stein | 403/102 X |
| 5,454,568 | 10/1995 | Richardson | 473/232 |
| 5,489,100 | 2/1996 | Potter | 473/232 |

FOREIGN PATENT DOCUMENTS

| | | | |
|---|---|---|---|
| 1301283 | 12/1972 | United Kingdom | 403/27 |

*Primary Examiner*—Harry C. Kim
*Attorney, Agent, or Firm*—Lowe, Price, LeBlanc & Becker

[57] ABSTRACT

A spring-loaded hinge for a training golf club comprises first and second hinge members (10, 20) pivoted to each other by a transverse pivot pin (30). Member (10) has a tongue (13) terminating in a generally circular arc (14) having a depression (15) therein, and member (20) has a pair of arms (23, 24) forming a fork between which the tongue (13) of member (10) is received, the pivot pin (30) passing through both arms and the tongue. Member (20) has an axial bore (25) containing a spring-loaded detent element (27) which bears against the circular arc (14) and engages in the depression (15). Member (20) is threaded externally at (43) towards the end opposite the pivot pin (30) and is slotted at (41) in the same region to provide communication with the bore (25) containing the spring (26). A threaded nut (42) engages with the screw thread (43) on the outside of that member (20) and a pin (40) passes through the slots (41) and engages with the end of the spring (26) in the bore (25) and with the nut (40), so that turning the nut (40) adjusts the spring tension. The nut conceals the pin (40) and slots (41), and the nut and the hinge member (20) adjacent thereto are marked (50, 51) to facilitate adjustment to desired settings.

6 Claims, 1 Drawing Sheet

GOLF TRAINING CLUBS

The present invention relates to golf clubs, and more specifically to training clubs designed to assist in the training and practising of golfers.

Achieving a good "swing" with a golf club, and in particular a driver, requires great skill, and perfecting a swing requires much practice. One major requirement is that the action should be smooth and free from any jerkiness. To assist golfers in achieving this, training clubs have been proposed in which the shaft is not rigid, so that it bends during a swing which is jerky.

More particularly, training clubs have been proposed in which the shaft incorporates a spring-loaded joint or hinge, so that for a swing within acceptable limits of smoothness the shaft remains straight, but for a swing which exceeds those limits, the shaft "breaks" at the joint. The club is generally constructed as a pair of half-shafts attached to a self-contained hinge structure. (The term "half-shaft" is used for convenience, but the location of the hinge is preferably closer to the head than the handle of the shaft.)

At least three specific designs for such clubs have been proposed, in Reineking U.S. Pat. No. 2,497,237. Koch & Koch U.S. Pat. No. 4,854,585 (Koch I), and Koch & Koch U.S. Pat. No. 5,195,748 (Koch II). In all these designs, the hinge is of a fork type; one hinge member has a pair of arms forming a fork, the other hinge member has a single arm (or tongue) which is received within the fork, and a pivot pin passes transversely through all three arms. The single arm terminates in a generally circular arc with a depression in it, and the other member has an axial bore containing a spring-loaded detent element which bears against the circular arc and engages in the depression in that arc. The two members include shanks by which they are attached to the two half-shafts of the club.

In this type of design, the hinge provides a single degree of freedom for the breaking of the shaft. The hinge pivot axis is oriented so that the shaft will not break under the acceleration of a properly executed swing, but if the club is jerked transversely or is twisted during the swing, then the shaft will break. This arrangement is well adapted for the prevention of a number of common swing faults.

The Reineking hinge is constructed so that it will hinge in only one direction, whereas the Koch hinges are constructed so that they will hinge in both directions (ie forward and backward). This distinction, though significant for the use of clubs incorporating the hinges for swing practice, is not relevant for present purposes.

The present invention is concerned with the sensitivity of hinges of this general type. It is clearly desirable for the sensitivity—ie the force which is necessary to "break" the hinge—to be accurately controlled.

In Koch I, the sensitivity of the hinge can be adjusted by changing the tension of the spring loading the detent element. The hinge member with the bore containing the spring is threaded, and a screw (termed an "adjusting screw") engages in the bore to hold the spring in place. This adjustment screw can be adjusted for initial setting. Once the screw has been adjusted, the two half-shafts of the club are attached to the two shanks of the hinge, sealing the screw against any further access. The adjustment provided by Koch I is thus a factory setting.

A fixed setting for the hinge force therefore has to be chosen as a compromise. An expert golfer who wants to improve their swing will already have a good swing, so for the club to be useful, it must have a low force setting which will allow the club to break even for a quite reasonable swing. A beginner, however, is likely to have a very poor swing at first. It is desirable that when such a player reaches a reasonable standard, the club should cease to break, and for this, the setting should be fairly substantial. Otherwise, the club will continue to break even with a substantial improvement in swing, and the beginner will become discouraged. It is therefore desirable that the club should have an adjustable setting or break force, with "adjustable" here meaning freely adjustable between different settings on the golf course (ie "in the field").

Reineking provides a club with such adjustability. This is achieved by providing a bore extending through the entire length of the handle half-shaft, with the spring extending along this bore to near the end of the handle. A screw (which Reineking terms a "tension adjusting and regulating screw") is provided in the end of the bore, engaging with a thread at that end. This makes the screw accessible, so by turning it, the compression of the spring, and hence the setting or force of the hinge, can be repeatedly set or adjusted in the field to any desired value.

However, this arrangement has significant disadvantages. For accessibility, the screw has to be located at the end of the handle half-shaft. The spring therefore has to extend along the whole length of the handle half-shaft from the screw to the detent element. The adjustment sensitivity is therefore small, even though the handle half-shaft is (in Reineking) considerably shorter than the head half-shaft. In other words, the screw will have to be moved a considerable distance along the bore, ie turned many times, to produce a substantial change in the setting of the club. If the hinge is located near the head end of the club, as in Koch & Koch, the sensitivity will be even less. Also, to adjust the position of the adjustment screw, a small screwdriver has to be used. In practice, many golfers will lose the screwdriver, and many more will be worried and/or irritated by the necessity to keep the small screwdriver somewhere safe but accessible and the danger of losing it.

Koch. II also provides adjustability or flexibility, in two ways.

First, the break forces for forward and backward breaking can be set at different values. The hinge is, as noted above, a fork type, with the single-armed shank terminating in a generally circular arc with a depression in it, and the other shank having an axial bore containing a spring-loaded detent element which bears against the circular arc and engages in the depression in that arc. In Koch II, the depression is in the form of an asymmetric V, so that a greater force is required to force the detect element up the steep side of the V than up the side With the gentler slope.

However, although this provides a degree of flexibility in a broad sense, the two break forces are obviously fixed by the angles at which the two sides of the V are manufactured, and cannot be adjusted.

Second, in Koch II the shank of the hinge member containing the axial bore and the spring is offset from the bore sufficiently far that the bore emerges at the "back end" of its half of the hinge, adjacent to the half-shaft attached to that hinge half. (The other hinge member has its shank similarly offset, for symmetry.) The bore is threaded, and the spring-loaded detent element is retained therein by a screw. This screw is therefore accessible, and can be turned to move it up or down the bore. The break force is therefore adjustable.

However, this arrangement is far from satisfactory in practice. As with Reineking, a separate small screwdriver is needed for adjustment, which is a significant disadvantage. Also, the offset hinge design looks awkward and results in unbalanced forces. Further, the adjustment is "blind"; ie there is no way of knowing what the current setting of the adjustment screw is apart from actually actually "breaking" the club (eg by a deliberately jerky swing), and that can only come from specialized experience which only a few golfers will have. Further, changing the adjustment is also difficult, involving "dead reckoning" using the angle through which the adjustment screw is turned. This requires the golfer to know or remember the proportionality between angle and change of force, and if the screwdriver slips or the golfer is clumsy, the setting (or change of setting) can easily become lost.

The main object of the present invention are to provide a training golf club with a hinge which can have its setting more readily adjusted and is more compact.

Accordingly the present invention provides a spring-loaded hinge for a training golf club, comprising first and second hinge members pivoted to each other by a pivot pin, the first member having a tongue terminating in a generally circular arc having a depression therein and the second member having an axial bore containing a spring-loaded detent element which bears against the circular arc and engages in the depression, characterized in that:

the second hinge member is threaded externally towards the end opposite the pivot pin and is slotted in that region to provide communication with the bore containing the spring;

a threaded nut engages with the screw thread on the outside of that member; and a force transmission element passes through the slot or slots and engages with the end of the spring in the bore and with the nut, so that turning the nut adjusts the tension in the spring.

The nut preferably conceals the slot or slots and force transmission element, and the nut and the hinge member adjacent thereto may conveniently be marked to facilitate adjustment to desired settings. The second hinge member may have a pair of arms forming a fork between which the tongue of the first hinge member is received, the pivot pin passing through both arms and the tongue. The second member may have two slots opposite each other, with the force transmission member being a pin extending through the slots.

The invention also provides a golf club using such a hinge.

This arrangement enables the length of the spring to be kept short, comparable with the length of the spring in Koch I and Koch II. A relatively small longitudinal movement of the nut can therefore produce a substantial change in the spring force. The manufacture and assembly of the hinge and the club including the hinge is simplified compared to Reineking or Koch II, as the hinge can be made complete with its adjustment means as a relatively compact unit to which the half-shafts of the club can then be attached. The hinge does not require the offsetting of Koch II. No screwdriver or other instrument is required to adjust the hinge; the nut can readily be turned manually. Further, the nut and shank or half-shaft may readily be marked to facilitate adjustment to desired settings.

A hinge embodying the invention will now be described, by way of example, with reference to the drawings, in which.

Figure 1:
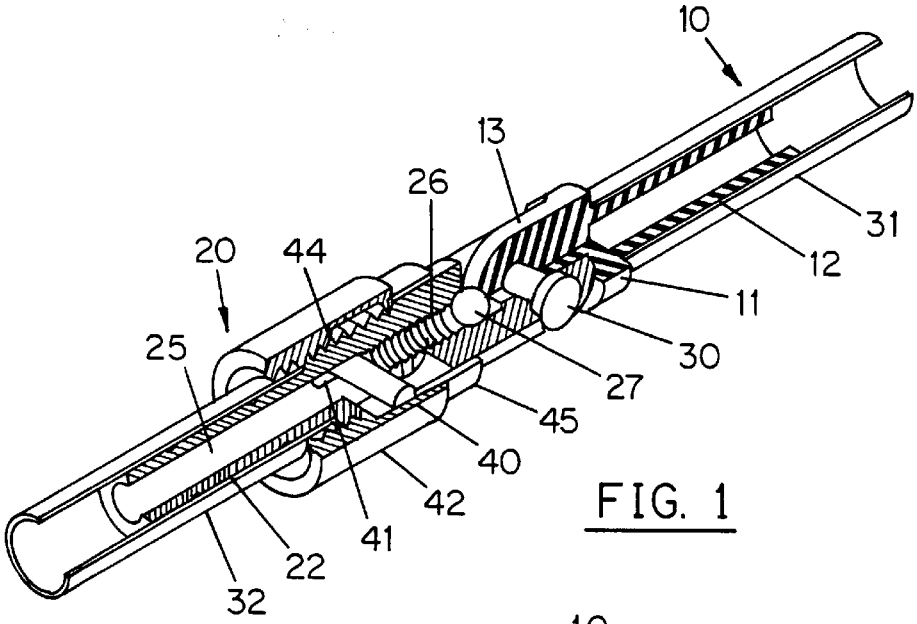
FIG. 1 is a quarter-section isometric view of the hinge with the inner ends of half-shafts.
Figure 2:
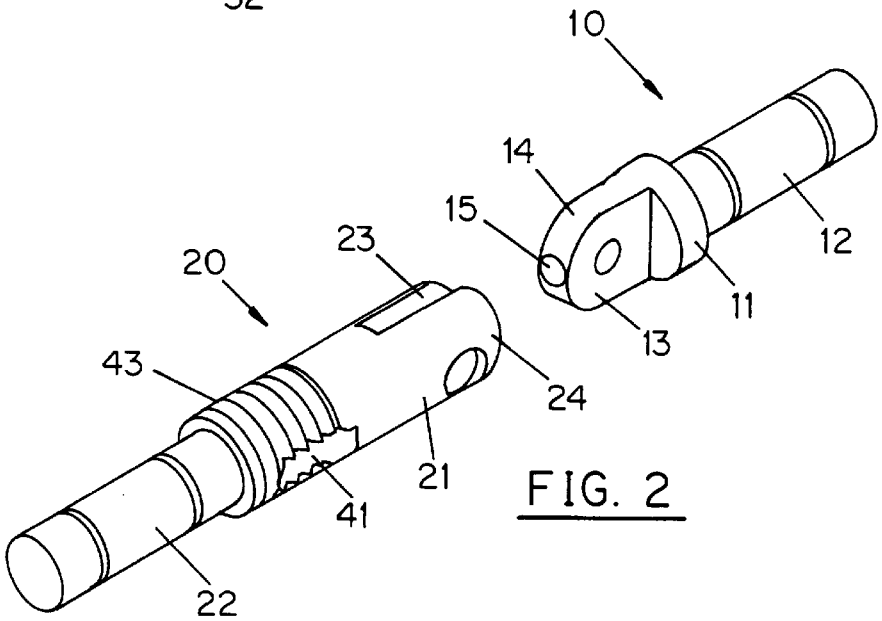
FIG. 2 is an exploded isometric view of the two main body parts of the hinge.
Figure 3:
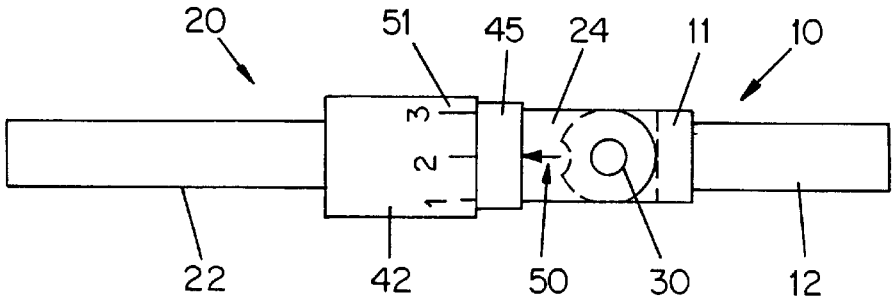
FIG. 3 is a side view of the hinge.

Referring to FIGS. 1 and 2, the hinge consists of two major hinge body members 10 and 20. Part 10 consists of a main cylindrical body II, narrowed at one end to form a spigot 12, and having at the other end a flat tongue 13 with a semicircular surface 14 as shown. Part 20 consists of a main cylindrical body 21, narrowed at one end to form a spigot 22, and having at the other end a pair of arms 23 and 24 with rounded ends, one on either side of the tongue 13. The spigots 12 and 22 both have axial bores. (The fact that spigot 12 is bored is not of particular significance; the importance of the bore of spigot 22 is discussed below.) A pivot pin 30 passes through arm 23, tongue 13, and arm 24 as shown, so that the two major components 10 and 20 are hinged together.

Head and handle half-shafts 31 and 32 (only the ends of which are shown) are attached to the spigots 21 and 22 to form the training golf club. It is convenient, but not essential, for the hinge portion 20 to be attached to the handle half-shaft. The spigots 12 and 22 are shown as being inserted inside the half-shafts 31 and 32, but the spigots could of course be made larger and the half-shafts have their ends inserted into the spigots.

The semicircular end 14 of the tongue 13 of member 10 has a depression 15 as shown. Further, the member 20 has a longitudinal bore 25 containing a compression spring 26 and a ball 27 which is urged by the spring 26 against the curved end 14 of the tongue 13 of the first body part 10 and into the depression 15. A detent mechanism is thereby formed, giving the hinge its "break" characteristic. To fold the hinge from its straight or in-line position as shown, enough force must be exerted to force the ball 27 up out of the depression 15 against the force of the spring 26. Once the ball has come free of the depression, however, the hinge can then freely swing further.

The design as described so far is conventional. Obviously, minor changes may be made to the design described, eg by using a suitably shaped pin in place of the ball 26.

In the present hinge, the upper end of the spring 26 is restrained by a pin 40, which protrudes through two longitudinal slots 4l located opposite each other in the body member 20. A nut 42 with internal threading at its left-hand end is located outside the body 20, and the body 20 is threaded externally at 43 to engage with this nut. The right-hand end of the nut 42 has a wider bore 44 than the threaded left-hand end. The ends of the pin 40 protrude beyond the slots 41 into this bore 44, and the narrower bore at the left-hand end of the nut 42 bears on these ends to hold the pin in position. By turning the nut 40 on the body 20, the nut will be moved along the body, thereby moving the pin up or down along the slots 41. The tension in the spring 26 will thereby be changed, and the break force of the hinge will thereby be adjustable.

The pin 40 may have enlarged ends knot shown), to assist in retaining it in position. The nut 42 has a sleeve 45 inserted into and attached to its bore 44, to conceal the pin 40 and slots 41 and thereby protect the pin, slots, bore 25, and spring 26. The nut 42 may similarly have a skirt or extension (not shown) of wider bore at its other end, to conceal the threading 43.

The outer surface of the nut 42 may have a convenient number of marks (e.g., 3) around its circumference, as shown at 51. A marker 50 formed on the upper end of the hinge body 20 will allow the hinge to be repeatably set to desired break forces, by turning the nut 42 to align the marker 50 on the hinge body with any desired one of the marks 51.

The marks 51 may be accompanied by numbers (eg 1 to 3 as shown). They may also be staggered longitudinally to match the longitudinal movement of the nut 42 as it is turned. The amount of stagger may be exaggerated to indicate clearly which direction the nut should be turned in to increase or decrease the tension and hence to increase or decrease the break force of the spring. (The user will normally realize that moving the nut downwards will compress the spring and so increase its tension and the break force of the spring.) Instead of or as well as numbers, the marks may be accompanied by suitable letters (eg L, N, and E for Learner, Normal, and Expert).

Obviously the details of this adjustment mechanism may be varied. Thus the number of slots may be varied. For example, with 4 slots, the pin 40 Would be replaced by an X-shaped element; if one of the slots is long enough, this element could be inserted through that slot by being held with its plane in the plane of that slot, and then turned perpendicular to the axis of the hinge body.

We claim:

1. A spring-loaded hinge for training golf club, comprising first (10) and second (20) hinge members pivoted to each other by a pivot pin (30), the first member having a tongue (13) terminating in a generally circular arc (14) having a depression (15) therein and a second member, having an axial bore (25) containing a spring and a spring-loaded (26) detent element (27) which bears against the circular arc (14) and engages in the depression (15), wherein the second hinge member (20) is threaded externally towards the end opposite of the pivot pin (30) to define a screw thread and includes a slot along the screw thread to provide communication with the bore (25) containing the spring (26);

a threaded nut (42) engaging with the screw thread (43) on the second hinge member (20); and a force transmission element (40) extending through the slot and engaging with the end of the spring (26) in the bore (25) and with the nut (40), so that turning the nut (40) adjusts the tension in the spring (26).

2. A hinge according to claim 1, wherein the nut is arranged to conceal the slot and the force transmission element.

3. A hinge according to claim 1, wherein the nut and the first hinge member adjacent thereto are marked to facilitate adjustment to desired settings.

4. A hinge according to claim 1, wherein the second hinge member has a pair of arms (23, 24) forming a fork between which the tongue (13) of the first hinge member is received, the pivot pin (30) passing through both of the arms and the tongue.

5. A hinge according to claim 1, wherein the second hinge member (20) has two said slots (41) opposite each other and the force transmission member (40) is a pin extending through the slots.

6. A golf training club comprising a handle half-shaft and a head half-shaft joined by said spring-loaded hinge according to claim 1.

* * * * *